United States Patent [19]

Hagmann et al.

[11] 4,240,529

[45] Dec. 23, 1980

[54] VERTICAL CONVEYING APPARATUS

[75] Inventors: Peter Hagmann, Daeniken; Lovro Markun, Suhr, both of Switzerland

[73] Assignee: Oehler-Whylen-Lagertechnik AG, Buchs bei Arrau, Switzerland

[21] Appl. No.: 948,097

[22] Filed: Oct. 2, 1978

[30] Foreign Application Priority Data

Oct. 6, 1977 [DE] Fed. Rep. of Germany ..... 2744986

[51] Int. Cl.[3] ..... B66B 5/16

[52] U.S. Cl. ..... 187/90; 188/188

[58] Field of Search ..... 187/89, 90, 86, 88; 254/174, 175; 188/188, 189

[56] References Cited

U.S. PATENT DOCUMENTS

| | | | |
|---|---|---|---|
| 1,581,459 | 4/1926 | Linquist | 187/90 |
| 3,441,107 | 4/1969 | Thorne et al. | 187/90 |
| 3,481,432 | 12/1969 | Walter | 187/90 |
| 3,509,970 | 5/1970 | Gabler | 187/90 |
| 3,653,467 | 4/1972 | Showalter | 187/89 |
| 4,078,634 | 3/1978 | Thomas | 187/90 |

*Primary Examiner*—Robert J. Spar
*Assistant Examiner*—Kenneth Noland
*Attorney, Agent, or Firm*—Abraham A. Saffitz

[57] ABSTRACT

Apparatus for conveying goods in vertical direction, such as a stacker crane or elevator, with a lifting unit and an emergency braking system which influences the lifting unit as soon as a preselectable speed is exceeded. The braking system comprises two wedges connected to an endless rope drive moving synchronously with the lifting unit. The rope drive moves only up to a preselectable top speed, and as soon as a speed difference between rope drive and lifting unit occurs, the brake wedges are activated and decelerate the lifting unit progressively until it stops.

3 Claims, 5 Drawing Figures

VERTICAL CONVEYING APPARATUS

BACKGROUND OF THE INVENTION

1. Field of the Invention

The present invention refers to a vertical conveying apparatus with a lifting unit guided in two guiding rails and with an emergency brake which influences the lifting unit as soon as a preselectable lifting speed is exceeded, to decrease the speed of the lifting unit. Such an apparatus is intended to work at high speed and acceleration even if the lifting unit is heavily loaded and must provide absolute safety against damage and accidents as a consequence of too high a lifting speed of the lifting unit.

2. Description of the Prior Art

For emergency brakes to be used with such apparatus or with elevators for humans, which are used to switch off the driving gear and to safely stop the lifting unit, it is imperative to provide a system which works absolutely reliably and effectively. The emergency braking systems known in the prior art work abruptly inasmush as a braking wedge provided with a toothed surface is suddenly pressed against a guiding or braking rail, whereby it often happens that the tooths of the braking wedge damage the surface of the guiding or braking rail, which is then ruined and subject to re-machining or replacement. The braking effect is very abrupt and the releasing of the braking system is sometimes very difficult. If the lifting unit is heavily loaded or subjected to a great acceleration or deceleration, there occurs the danger that passengers on the lifting unit may be severely injured by the sudden stop common to the emergency braking systems of the prior art. This danger can only partially be avoided by overdimensioning the driving and braking system.

If an automatic position coding system is used with such an apparatus, it may happen that the lifting unit stops between two distance marks if the emergency braking system is activated, thereby rendering it impossible to determine the actual position of the lifting unit by means of the remote control system.

OBJECTS OF THE INVENTION

It is an object of the present invention to propose a vertical conveying apparatus with a lifting unit guided by two vertically arranged guiding rails and equipped with an emergency braking system, which avoids the disadvantages mentioned above. A further object of the invention is to provide such an apparatus with an emergency braking system which, once actuated, decelerates the lifting unit progressively but nevertheless reliably, as soon as a predetermined conveying speed is exceeded.

SUMMARY OF THE INVENTION

The apparatus according to the invention comprises at least two braking wedges, each acting on a pair of vertical guide rails and movable together with the lifting unit and displaceable in relation to this lifting unit. The wedges are floatingly suspended from a lever mechanism and are connected to an endless rope drive moving synchronously with said lifting unit whereby a decrease in the speed of the rope drive relative to the speed of the lifting unit causes a displacement of said braking wedges to decelerate and stop the motion of said lifting unit. The braking wedges are arranged to cooperate with a parallel wear strip, one strip at each of the two lateral shoulders of the head of the guiding rails so that each wedge comes into instantaneous full face braking engagement with its corresponding parallel wear strip and are slideably received in supporting members to be displaceable in a horizontal direction by wedging action relative to said supporting members. The supporting members are joined by two or more parallel bolts which engage cup springs and washers to a supporting block rigidly connected to the lifting unit whereby the braking wedges move in full face engagement against the parallel wear strips against the spring forces of the cup springs of said bolts to gradually increase the wedging pressure from gentle pressure to full force braking.

Thus the brake falls downwardly in full face engagement and is drawn by lever means and by frictional forces between the face of the wedge and the left shoulder of the head of the guide rail between the wear strip and the right shoulder of the guide rail head until the wedge has fully compressed the springs associated with the outwardly movable support block.

BRIEF DESCRIPTION OF THE DRAWINGS

In the following a preferred embodiment of the apparatus according to the invention will be described, with reference to the accompanying drawings, in which.

DESCRIPTION OF THE PREFERRED EMBODIMENT

Figure 1:
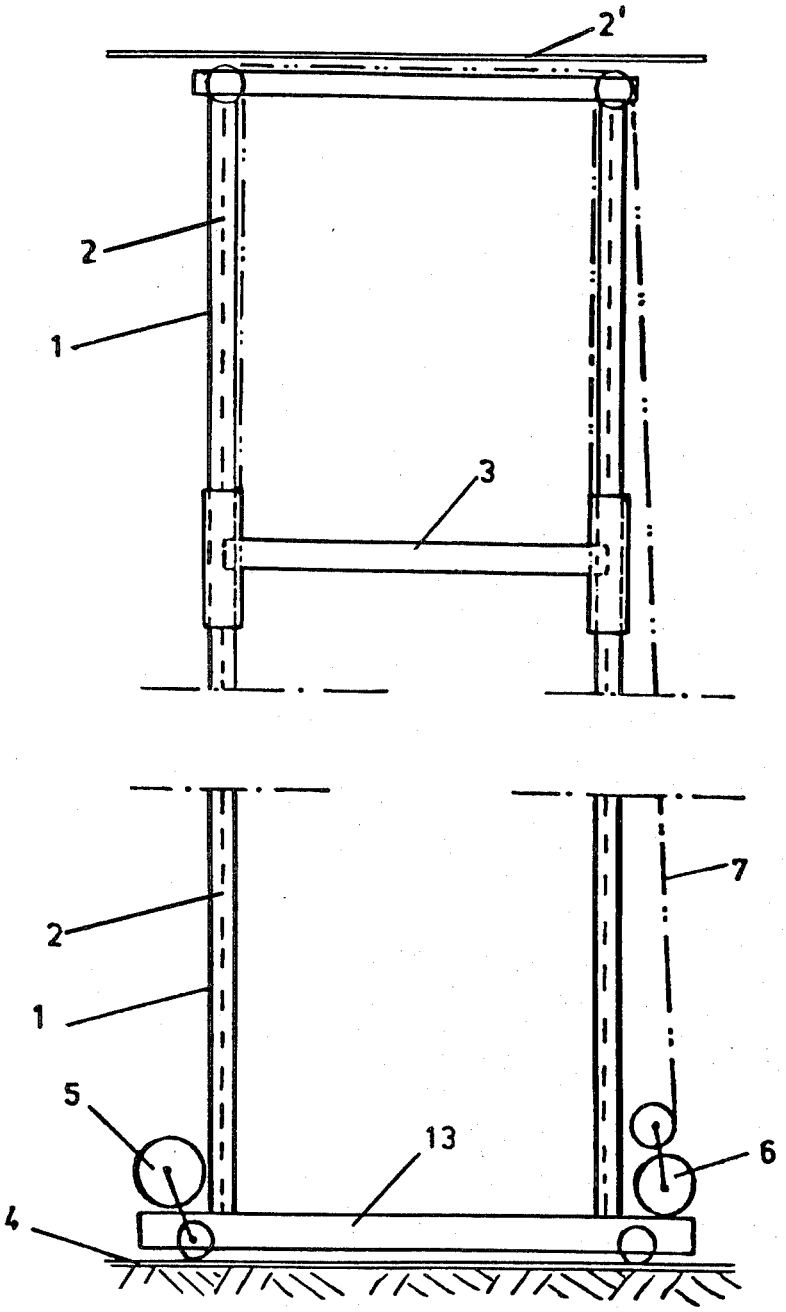
FIG. 1 shows a schematic side view of a stacker crane.

The stacker crane shown in FIG. 1 comprises two lifting posts 1 which are arranged on a base plate 13. The base plate 13 is travelling on rails 4 which are arranged on the ground floor. A driving gear 5 is provided to drive the stacker crane along the rails 4. On the top, there is provided a horizontal guiding rail 2' to guide the stacker crane and to improve its stability. Each of the lifting posts 1 is equipped with a vertically extending guiding rail 2 which receive and guide a lifting unit 3. A rope drive 7 is provided to lift and lower the lifting unit 3, which comprises a driving gear 6. The stacker crane is equipped with an emergency brake to decelerate and stop the lifting unit 3 as soon as a predetermined lifting or lowering speed is exceeded by more than 40%. In the embodiment now to be further described, the normal lifting or lowering speed is 50 m/min, and consequently the emergency brake will be activated as soon as the speed exceeds 70 m/min. The travel of the lifting unit 3 is more than 18 meters and the maximum load received on the lifting unit may be up to 5 tons.

Figure 2:
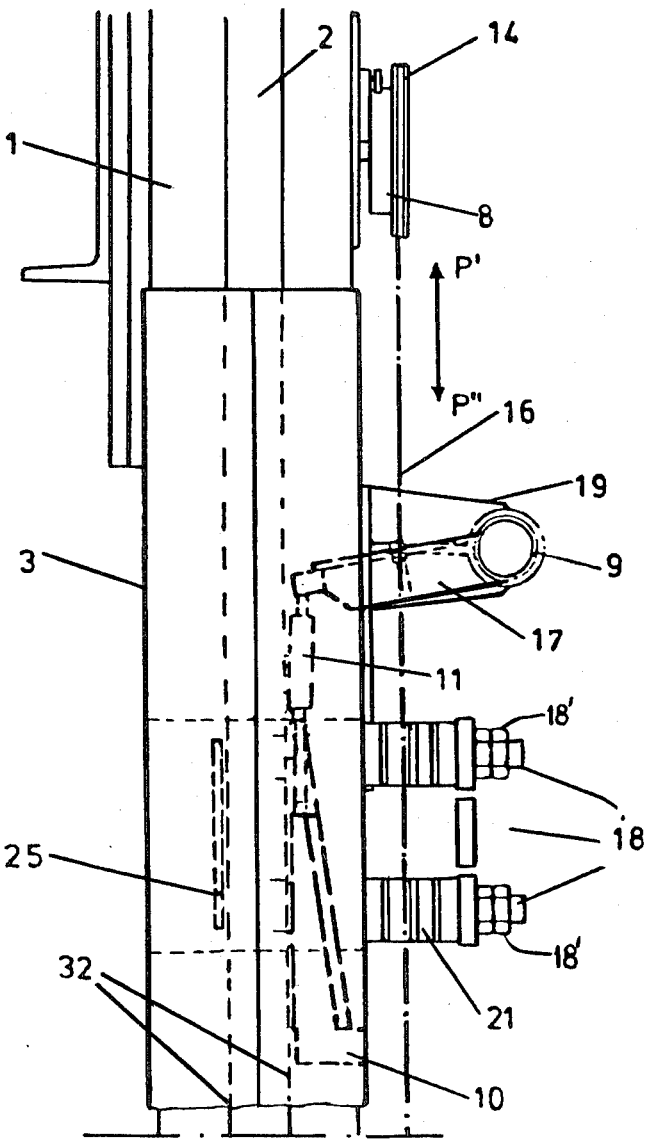
FIG. 2 shows some details of the lifting unit in a side elevation, partially cut away.
Figure 2:
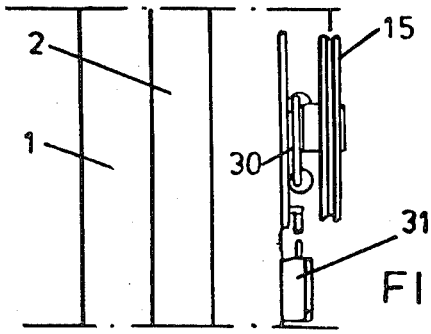

As can be seen in FIG. 2, there are provided endless steel ropes 16 which are guided by sheaving pulleys 14 and 15 and which are connected to the lifting unit 3 to monitor its lifting speed. The upper sheaving pulley is rotatably arranged at the top of the guiding rail 2, while the lower sheaving pulley 15 is mounted on a tension slide 30 providing enough tension in the rope 16 that no slipping between rope 16 and pulleys 14 and 15 can occur. The steel rope 16 is thereby connected to a lever 17 of the emergency brake, which is mounted on the lifting unit 3.

Figure 4:
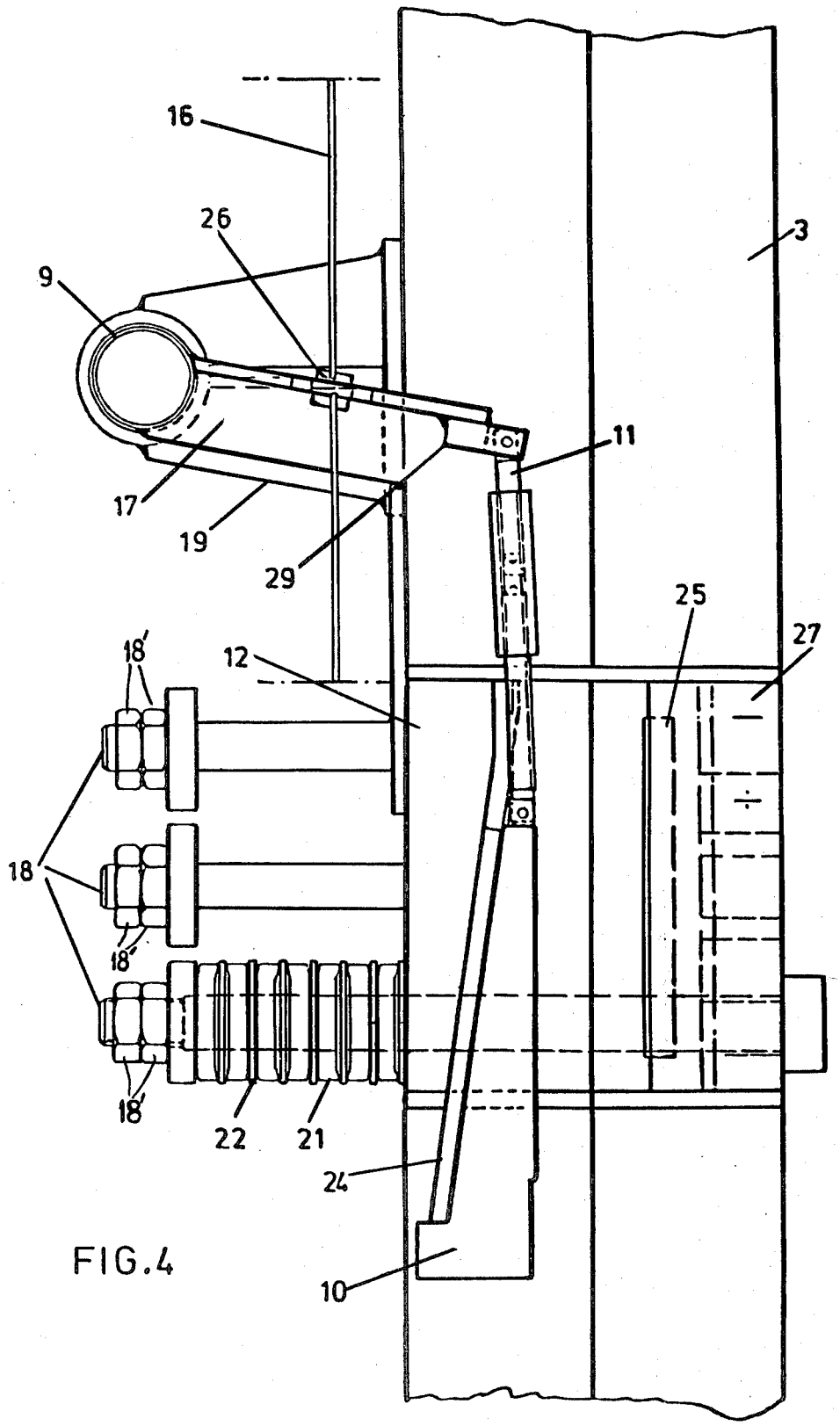
FIG. 4 shows an enlarged detail from FIG. 2, turned by 180°.
Figure 5:
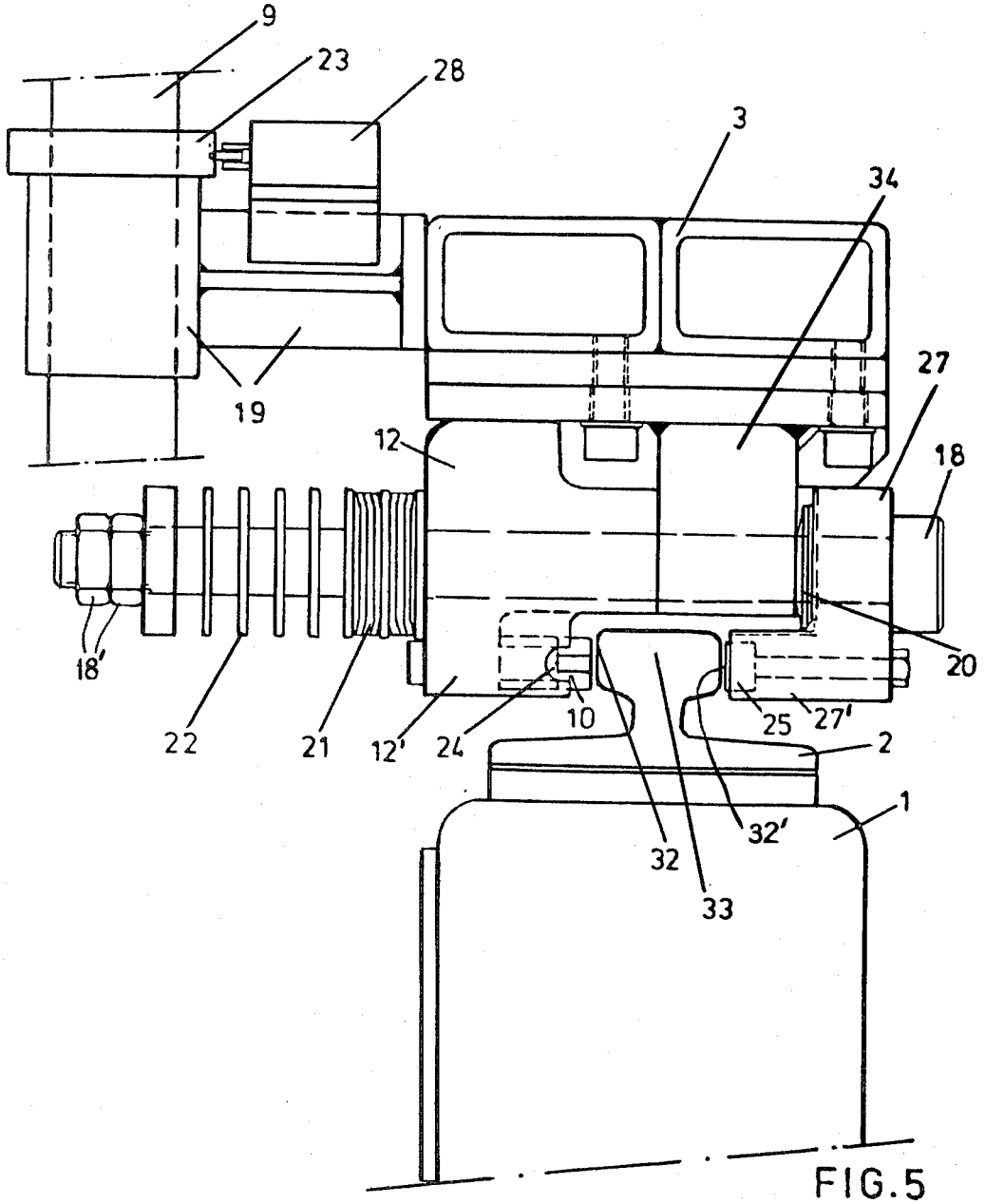
FIG. 5 shows an enlarged detail from FIG. 3.

The design and construction of the emergency brake can best be seen in FIGS. 4 and 5. The lifting unit 3 is provided with a support member 34, comprising on its left side a support block 12 and on its right side a counterpart 27. All three parts 34, 12 and 27 have a number of bores and are held together by means of rigid bolts 18 and nuts 18', whereby a number of distance washers 22 and cup springs 21 are inserted between nuts 18' and support block 12 and a number of cup springs 20 are inserted between support member 34 and counterpart 27. The provision of the cup springs 20 and 21 enable the support block 12 and the counterpart 27 to be displaced along the bolt 18 in relation to the support member 34 by a small amount. Under the influence of the cup springs 21, the support block 12 is pressed against the left side of the support member 34 and the counterpart 27 to the right side of the support member 34, whereby the amount of pressure can be selected by tightening the nuts 18' more or less. In this way the cup springs 20 and 21 can be selectively biased.

Figure 3:
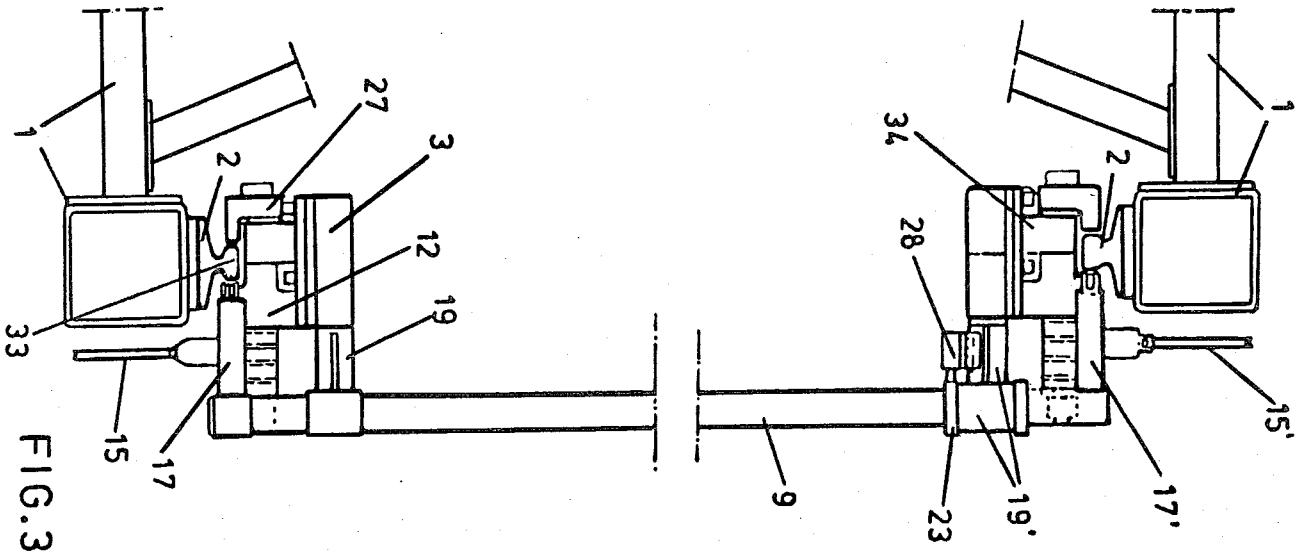
FIG. 3 shows a horizontal section through the two lifting posts of the stacker crane and a top view on the two braking systems on the left and the right side.

The support block 12 comprises a protruding portion 12' reaching to the left shoulder 32 of the head 33 of the rail 2, while the counterpart 27 is equipped with a corresponding protruding portion 27' reaching to the right shoulder 32' of the head 33 of the rail 2. The protruding portion 12' has a groove which receives a braking wedge 10 with a guiding rod 24 bolted thereon. As can be seen in FIG. 4, the braking wedge 10 is suspended to the free end of the lever 17 by means of a linkage 11, whereby the lever 17 is pivotably arranged by a connecting rod 9, the ends of which are rotatably received in two supports 19 and 19' mounted on the lifting unit 3. On the other side of the lifting unit 3, there is provided, as shown in FIG. 3 a further lever 17' which activates a corresponding braking wedge (not shown).

The upper sheaving pulley 14 comprises a built-in centrifugal governor 8 which decelerates the pulley 14 as soon as a predetermined revolution speed is exceeded. As a consequence, the rope 16 also decreases its speed relative to the lifting unit 3 and the lever 17 is pivoted upwardly in the direction of arrow P' in FIG. 2. The lever 17' on the other side of the lifting unit 3 being rigidly coupled with the lever 17 by means of the connecting rod 9, it will also be pivoted in a clockwise direction, so that both wedges 10 are displaced upwardly and come into contact with the shoulders 32 of the head 33 of the rails 2. The lifting unit 3 is thereby braked in a progressive manner, as the cup springs 20 and 21 are more and more compressed while the braking wedges 10 are displaced upwardly. Thus, the braking of the lifting unit begins gently and gets progressively stronger as the wedge 10 is drawn upwardly and the cup springs 20 and 21 are compressed.

Simultaneously, a wear strip 25 arranged on the protruding portion 27' of the counterpart 27 is pressed against the right shoulder 32' of the head 33 of the rail 2, as the counterpart 27 is displaced against the force of the springs 20 to the support member 34. Preferably, the surface of the wedge 10 which contacts the shoulder 32 is roughened.

The desired braking effect can be selected by the number and the characteristics of the cup springs 20 and 21 and by tightening and loosing the nuts 18'.

As can be seen in FIG. 5, the connecting rod 9 comprises a control disc 23 rotating with the rod 9 and cooperating with a limit switch 28, which is activated as soon as a preselectable position of the lever 17 is reached. Thereby the drive of the lifting unit 3 is switched off.

In most cases, the emergency brake can easily be released by reversing the drive 6 for the lifting unit 3. Thereby the centrifugal governor 8 releases the pulley 14 which now can freely rotate and the rope 16 is displaced in the direction of arrow P'' until the lever 17 abutes against a stop edge 29. If it should happen that the braking wedge 10 is so heavily blocked that it cannot be pushed out, the brake can be released by loosening the nuts 18' on the bolts 18 so that the cup springs 20 and 21 become free moving and are somewhat decompressed.

In order to monitor the tension of the rope 16, there is provided a limit switch 31 below the tension slide 30. If the rope 16 is flabby or broken, the slide 30 will be displaced downwardly and activate the limit switch 31, which then will activate an alarm signal or switch the drive of the lifting unit 3 off.

The apparatus according to the present invention has the important advantage, that the lifting unit can be stopped within an exactly defined braking path by selecting the number and the characteristics of the cup springs, whereby the braking is progressive, i.e. it begins gently and gets stronger. All parts of the construction can be made lighter but there remains nevertheless enough braking power. If passengers are on the lifting unit, any injuries can be avoided as the deceleration forces can be calculated in advance. A further advantage lies in the fact that no damage or wear of the guiding rails can occur, especially if the wedges are guided by bronze rods 24 and coacting wear strip 25 as explained before.

What we claim is:

1. A vertical conveying apparatus with a lifting unit and an emergency braking system, which decelerates the speed of the lifting unit as soon as a preselected top speed is exceeded, comprising;

at least two vertically arranged guiding rails for the guiding of the movement of said lifting unit, each guiding rail having shoulders and a parallel wear strip along said shoulder;

at least two braking wedges arranged on both sides of said lifting unit for movement with said lifting unit, each wedge acting against one of said rails and each wedge being vertically displaceable relative to said lifting unit;

a lever mechanism connected to said braking wedges, said braking wedges being each floatingly suspended from lever mechanism and an endless rope drive;

an endless rope drive moving synchronously with said lifting unit constructed and arranged so that a decrease in the speed of the rope drive relative to the speed of the lifting unit causes a displacement of the braking wedges to decelerate stop the lifting unit;

supporting members for slideably receiving said wedges and to permit horizontal displacement of said wedges under wedging action;

said braking wedges instantaneously coacting in frictional full face engagement with its corresponding parallel wear strip at the shoulder of the vertical guide rail, said wedges being slideably received in said supporting member for adjustable pressing movement from gentle pressing to full force braking against said parallel wear strips;

a supporting block rigidly connected to said lifting unit;

a plurality of bolts in parallel, each fitted with cup springs, washers and fasteners to secure said supporting members to said supporting block; and said cup springs providing spring forces in opposition to the wedging forces of said braking wedges whereby the wedge pressure may be progressively increased from gentle breaking forces to full force braking.

2. Apparatus according to claim 1 wherein said lever mechanism connected to said braking wedges and said endless rope drive comprises a pivotable lever a bearing block, and a connecting rod which is common to the two levers one associated with each wedge, said bearing block being mounted on said lifting unit and said lever linkage being remote from said connecting rod to provide the connection between said lever mechanism and said endless rope drive and to cause said wedges to rise and brake said lifting unit under the pivotable movement of said levers.

3. An apparatus as claimed in claim 2 wherein said endless rope drive comprises upper and lower sheaving pulleys, said lower sheaving pulley having a vertical tension slide to tension the rope and said rope drive is provided with a limit switch below said tension slide which is activated when the rope is loose or broken to thereby cut off the operation of the drive.

* * * * *